US011319691B2

(12) United States Patent
Oliver et al.

(10) Patent No.: US 11,319,691 B2
(45) Date of Patent: May 3, 2022

(54) ANCHOR PIER FOR MANUFACTURED BUILDING

(71) Applicant: Oliver Technologies, Inc., Hohenwald, TN (US)

(72) Inventors: Scott Oliver, Linden, TN (US); John Oliver, Linden, TN (US); Daniel Oliver, Linden, TN (US); James Oliver, Linden, TN (US)

(73) Assignee: OliverTechnologies, Inc., Hohenwald, TN (US)

( * ) Notice: Subject to any disclaimer, the term of this patent is extended or adjusted under 35 U.S.C. 154(b) by 0 days.

(21) Appl. No.: 16/990,531

(22) Filed: Aug. 11, 2020

(65) Prior Publication Data

US 2020/0392689 A1 Dec. 17, 2020

Related U.S. Application Data

(60) Division of application No. 16/657,777, filed on Oct. 18, 2019, now Pat. No. 10,767,337, which is a continuation of application No. 16/231,699, filed on Dec. 24, 2018, now abandoned, which is a division of application No. 15/413,842, filed on Jan. 24, 2017, now Pat. No. 10,161,098, which is a division of application No. 14/473,773, filed on Aug. 29, 2014, now Pat. No. 9,970,175, which is a division of application No. 12/868,160, filed on Aug. 25, 2010, now Pat. No. 8,844,209, which is a continuation of application No. 12/858,027, filed on Aug. 17, 2010, now abandoned, which is a continuation-in-part of application No. 12/777,038, filed on May 10, 2010, now Pat. No. 8,833,020.

(60) Provisional application No. 61/177,103, filed on May 11, 2009.

(51) Int. Cl.
*E02D 27/50* (2006.01)
*E04B 1/343* (2006.01)

(52) U.S. Cl.
CPC ..... *E02D 27/50* (2013.01); *E04B 1/34347* (2013.01); *E04B 1/34352* (2013.01); *Y10S 52/11* (2013.01)

(58) Field of Classification Search
CPC . E02D 27/50; E04B 1/34352; E04B 1/34347; Y10S 52/11
See application file for complete search history.

(56) References Cited

U.S. PATENT DOCUMENTS 897,787 A * 9/1908 Hindmarsh ..... E02D 5/801 52/156
1,214,679 A * 2/1917 Ryan ..... E04H 12/2215 52/153
3,380,205 A * 4/1968 Ratchford ..... E04B 1/0007 52/126.7

(Continued)

*Primary Examiner* — Adriana Figueroa
(74) *Attorney, Agent, or Firm* — Baker Donelson; Carl M. Davis, II

(57) ABSTRACT

An anchor pier for supporting a manufactured building, in which the anchor pier includes having a shaft with a connector and a helical flight proximate a driving tip, with a brace member attached to the connector and to the manufactured building with a connector, to transfer loading between the manufactured building and the ground. A method of supporting a manufactured building is disclosed.

20 Claims, 14 Drawing Sheets

(56) References Cited

U.S. PATENT DOCUMENTS 3,724,151 A * 4/1973 Kaywood ..... B60P 3/073 52/295
3,828,491 A * 8/1974 Koon ..... E04B 1/34347 52/23
3,830,024 A * 8/1974 Warnke ..... E04B 1/34347 52/23
4,272,933 A * 6/1981 Lopes ..... E04B 1/34347 52/149
4,417,426 A * 11/1983 Meng ..... E04B 1/34352 52/126.7
4,546,581 A * 10/1985 Gustafson ..... E02D 27/34 52/126.6
4,756,128 A * 7/1988 Danieli ..... B63B 21/26 135/118
4,899,497 A * 2/1990 Madl, Jr. ..... E04B 1/0007 52/126.6
4,914,875 A * 4/1990 Gustafson ..... E04B 1/34352 52/126.6
5,515,655 A * 5/1996 Hoffmann ..... E02D 27/01 248/354.5
5,697,191 A * 12/1997 MacKarvich ..... E02D 27/48 52/169.9
5,850,718 A * 12/1998 MacKarvich ..... E04B 1/34347 52/292
5,862,635 A * 1/1999 Linse ..... E04H 9/14 52/126.6
6,094,873 A * 8/2000 Hoffman ..... E02D 27/01 52/126.6
6,119,412 A * 9/2000 Jackson ..... E04B 1/34352 248/188.1
6,243,998 B1 * 6/2001 MacKarvich ..... E02D 27/02 52/167.3
6,247,276 B1 * 6/2001 Masters ..... E04H 9/14 52/169.12
6,256,940 B1 * 7/2001 MacKarvich ..... E02D 27/02 52/126.6
6,272,798 B1 * 8/2001 Cockman ..... E02D 5/801 135/118
6,298,611 B1 * 10/2001 Oliver ..... E02D 5/801 248/156
6,453,627 B1 * 9/2002 Powers ..... B60P 3/36 248/354.3
6,568,147 B1 * 5/2003 Sumner, Sr. ..... E02D 27/02 52/169.9
7,191,569 B2 * 3/2007 Brown ..... E02D 5/801 52/111
2002/0088187 A1 * 7/2002 Howard ..... E02D 27/50 52/162
2005/0011149 A1 * 1/2005 Mard ..... E02D 27/01 52/292
2009/0038240 A1 * 2/2009 Leonard ..... E04B 1/34347 52/169.9

* cited by examiner

ANCHOR PIER FOR MANUFACTURED BUILDING

The present application is a continuation-in-part of U.S. non-provisional patent application Ser. No. 12/858,027, filed Aug. 17, 2010, a continuation-in-part of U.S. non-provisional patent application Ser. No. 12/777,038, filed May 10, 2010, each incorporated herein by reference and claims the benefit of U.S. Provisional Patent Application Ser. No. 61/177,103, filed May 11, 2009.

TECHNICAL FIELD

The present invention relates to supports for manufactured buildings. More particularly, the present invention relates to an anchor pier to support manufactured buildings installed on a ground surface.

BACKGROUND OF THE INVENTION

Manufactured buildings, such as manufactured or mobile homes and offices, are constructed and assembled at an initial manufacturing facility, and then moved on wheels to the installation site. The manufactured building typically includes long, longitudinal support beams underneath the building to support the floor of the building. During typical installation, a plurality of piers are placed between a ground surface and the support beam to support the building on the site. The piers sit on or are attached to footings such as metal plates or pans, plastic plates, or concrete pads placed on the ground.

Different types of piers are known. One type of pier uses stacks of blocks that sit on footings and transfer load from the support beam. Other piers use metal tubular members that connect between a ground pan and the support beam.

Some foundation systems for manufactured buildings also resist lateral and longitudinal wind and/or seismic forces on the building. These foundation systems typically use a ground pan and an elongated strut connected at a lower end to the ground pan and at the upper end to a support beam of the manufactured building. The elongated strut can be oriented parallel to a longitudinal axis of the support beam or extend laterally from underneath one support beam to connect to the adjacent support beam of the manufactured buildings, or both. Such foundations provide resistance to wind and/or seismic forces in the lateral and longitudinal directions.

Often the support beam is positioned inwardly of a perimeter of the manufactured building. The floor structure of the manufactured building includes a plurality of joists that are positioned in spaced-apart relation and transverse to a longitudinal axis of the support beams. The joists extend outwardly of the support beams to a perimeter wall of the manufactured building.

While the piers and foundation systems have been successful in supporting installed manufacturing buildings and resisting wind and/or seismic loads on installed manufactured buildings, there are drawbacks to these systems. Laterally extended portions of floor of the manufactured building may sag over time, for example, due to settlement of the ground under the piers of the manufactured building. The manufactured building may become out of level. Further, frost heave can reduce holding and supporting capability of foundation members. Heave in soil occurs when the water in the ground freezes. The freezing water expands, and causes the ground to heave up or rise up or swell. Frost heave causes the foundation ground pans (or pads) to move. This movement is communicated to the house through the elongated struts between the ground pan and the support beam, and may contribute to the house becoming out of level. A manufactured building that is not level can result in openings in the manufactured building becoming out of skew. This causes doors, such as in exterior doorways, to become skewed and not open or close properly. Windows in perimeter walls likewise become difficult to open and close.

It is believed that there are three factors that contribute to frost heave. These factors are the soil being sufficiently saturated with water, the atmospheric temperature, and the duration of the saturation and cold temperatures. Efforts to resist frost heave have been made. Typically in areas that experience significant frost heave, the foundation must be engineered and extend below the frost line. This requires excavation of an in-ground footing and installation of a rigid or engineered foundation such as concrete footers and pilings. In other areas, skirting attaches around the perimeter of the manufactured home. The skirting extends from a lower edge of the manufactured home to the ground. The skirting encloses the space between the ground and the bottom of the manufactured home. Skirting used on the perimeter of manufactured buildings placed at sites with pier supports is not entirely successful in reducing or eliminating frost heave. Even with skirting, manufactured buildings placed at sites with periphery pier supports and not having engineered foundations, are susceptible to frost heave of the ground below the ground pan or pad.

To provide foundations that resist the effects of frost heave, installers dig holes below the frost line and fill with concrete. Connecting members, embedded in concrete, connect to the manufactured building. However, digging foundation holes and pouring concrete foundations is time-consuming, costly and difficult, particularly during periods of freezing weather.

Accordingly, there is a need for a ground anchor to support manufactured buildings. It is to such that the present invention is directed.

BRIEF SUMMARY OF THE INVENTION

The present invention meets the need in the art by providing an anchor pier for supporting a manufactured building, comprising a shaft having a U-shaped connector having a base attached at a first end of the shaft and a driving tip at an opposing end with at least one helical flight positioned proximate the driving tip, for driving through a surface of ground beneath a manufactured building to position the U-shaped connector proximate the surface, for interaction of the shaft and the helical flight with the ground to communicate vertical loading between the building and the ground. A pair of opposed side walls upstanding from the base, each side wall defining an opening aligned with the opening in the opposing side wall. A brace member defining a through opening proximate a first end for attaching at a first end to the U-shaped connector and attaching at a second end to the manufactured building for vertically supporting the manufactured building relative to the ground. A first fastener extending through the aligned openings in the opposing side walls and the brace member for engaging the first end of the brace member to the U-shaped connector. A strap for securing at a first end to the U-shaped connector and at a second end to the manufactured building, said strap extending perpendicular from the U-shaped connector to the manufactured building. The shaft and helical flight driven into the ground below the manufactured building transfers vertical compression loading from the manufactured building through the brace member to the ground and the strap resists vertical tension loading on the manufactured building.

In another aspect, the present invention provides a method of supporting a manufactured building, comprising the steps of:

(a) driving a shaft into a ground surface below a portion of a manufactured building, the shaft having a U-shaped connector having a base attached at a first end of the shaft and a driving tip at an opposing end with a helical flight positioned proximate the driving tip and a pair of opposed side walls upstanding from the base, each side wall defining an opening aligned with the opening in the opposing side wall; and (b) attaching a first end of a brace member to the U-shaped connector and attaching a second end of the brace member to the manufactured building, the brace member defining a through opening proximate a first end for alignment with the openings in the opposing side walls for receiving a fastener therethrough; and (c) securing a strap at a first end to the U-shaped connector and extending perpendicular therefrom and securing at a second end to the manufactured building, whereby the shaft and the helical flight transfers vertical loading on the manufactured building through the brace member to the ground below the manufactured building while the strap resists vertical tension loading on the manufactured building.

Objects, advantages, and features of the present invention will be apparent upon a reading of the detailed description together with observing the drawings and reading the appended claims.

DETAILED DESCRIPTION

Figure 1:
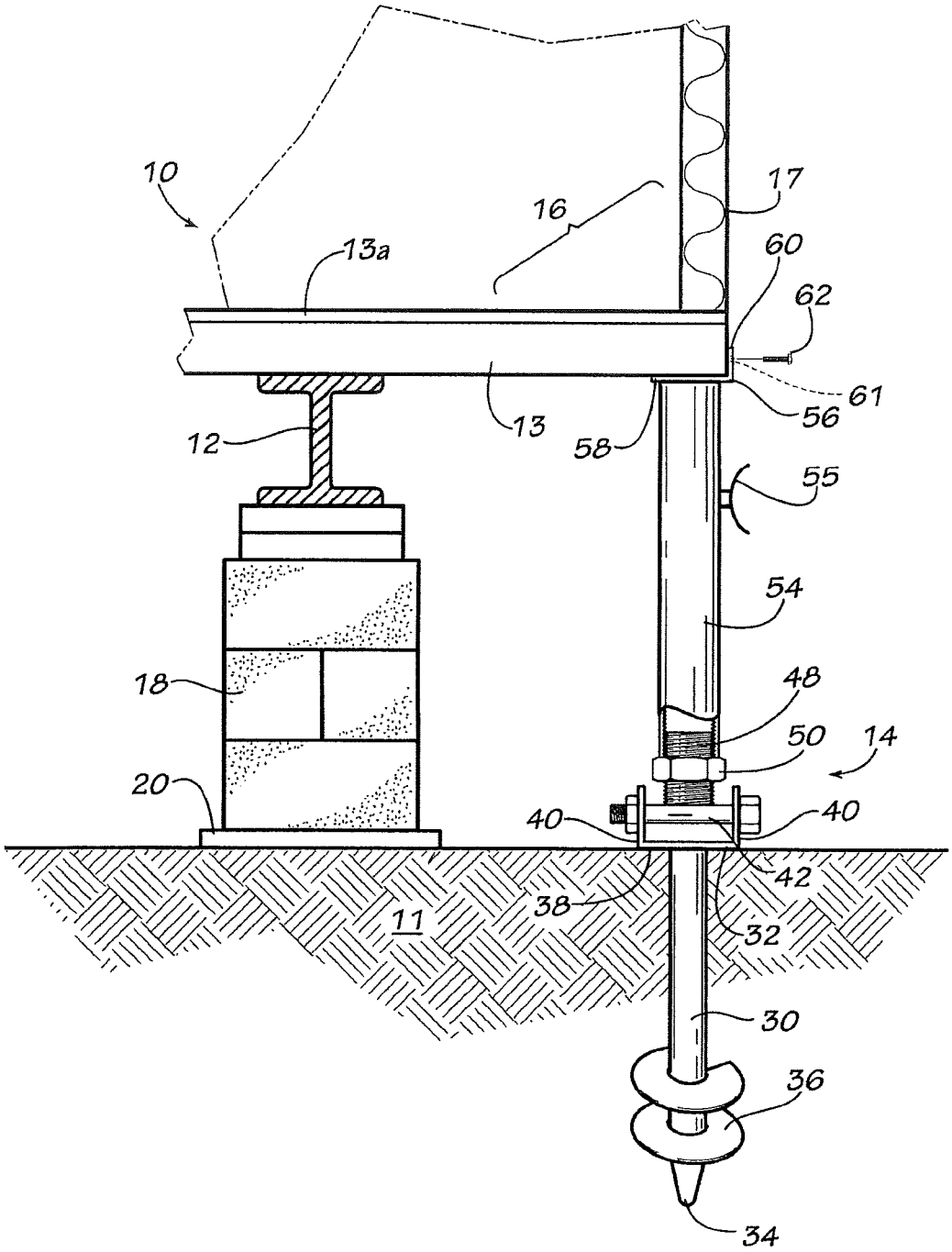
FIG. 1 illustrates in side elevational view a manufactured building with an embodiment of an anchor pier according to the present invention supporting a perimeter portion of the manufactured building.

With reference to the drawings, in which like elements have like identifiers, FIG. 1 illustrates a portion of a manufactured building 10 supported on a ground surface 11 by one or more long, longitudinal support beams 12. The support beams 12 conventionally are I-beams having a central web with spaced-apart upper and lower forward and rearward laterally extending opposing flanges. The beams 12 underneath the manufactured building support the plurality of spaced-apart joists 13 disposed transverse to the longitudinal axis of the support beams 12. The joists 13 support a floor 13*a* of the manufactured building.

An embodiment of an anchor pier 14 in accordance with the present invention supports the manufactured building as a foundation. FIG. 1 illustrates the anchor pier 14 supporting a perimeter portion 16 of the manufactured building that includes an upwardly extending sidewall 17. In an illustrative application, the anchor 14 is positioned to support a wall portion having a doorway entrance and door conventionally positioned in the wall. Piers 18 sit on footings, for example, on concrete pads or poured columns, plastic pads, or steel members or pans. FIG. 1 illustrates a metal ground pan 20 and the pier 18 sits on the ground pan and extends to the support beam 12 for transferring loading from the manufactured building to the ground. It is to be appreciated that the present invention is also gainfully used with modular buildings that do not have frames but rather the foundation directly supports the floor or the joists of the floor.

The anchor pier 14 includes a shaft 30 having a connector 32 at a first end and a distal tip 34 at an opposing end. One or more helical thread members 36 attach in spaced-apart relation to the shaft 30 proximate the distal tip 34. The connector 32 defies a U-shape with a base plate 38 and a pair of opposing upstanding side walls 40. The side walls 40 each define an opening aligned with the opening in the opposing side wall.

Figure 2A:
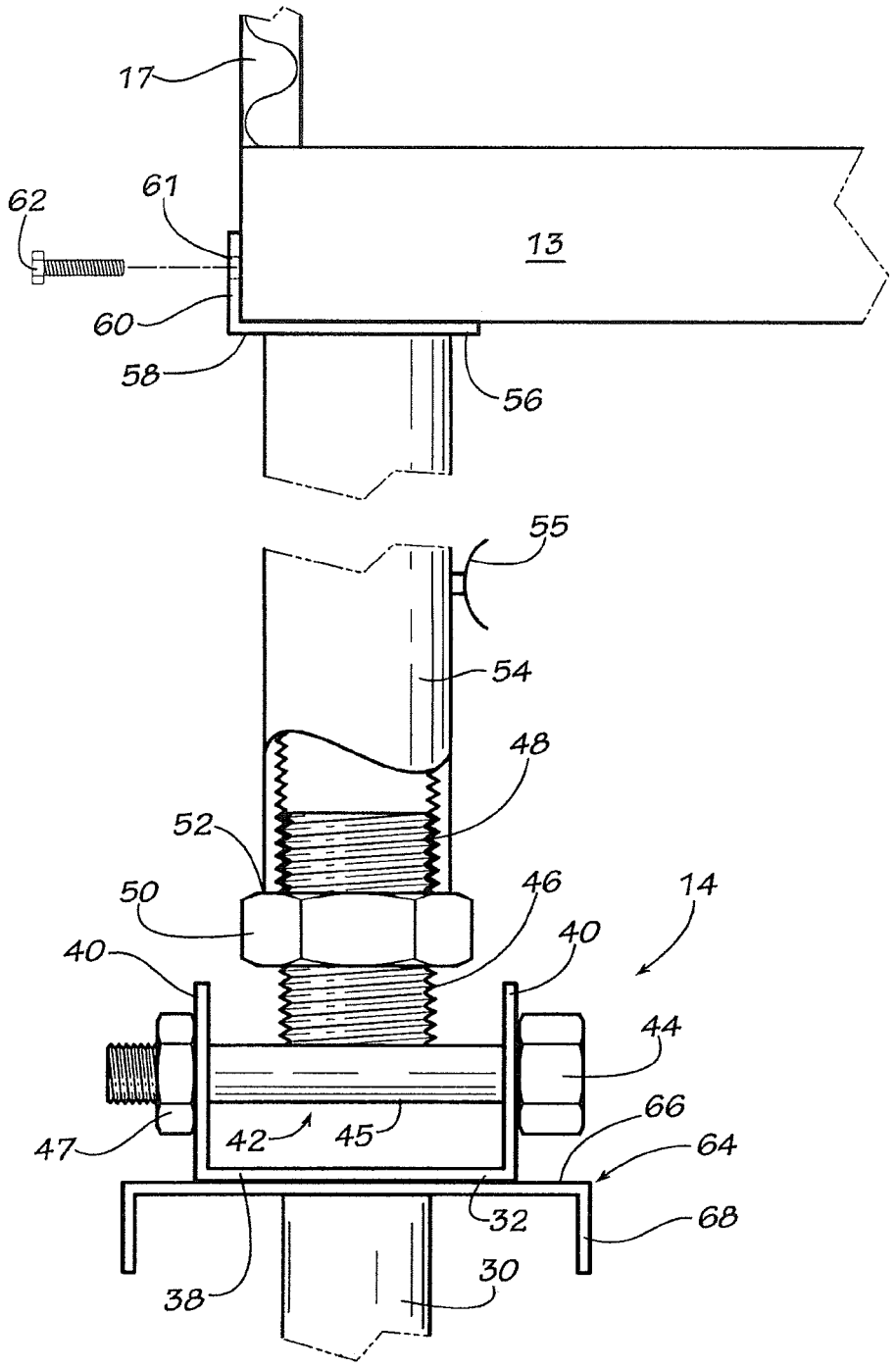
FIG. 2A illustrates in detailed side elevational view the anchor pier illustrated in FIG. 1 supporting a perimeter portion of the manufactured building.
Figure 2B:
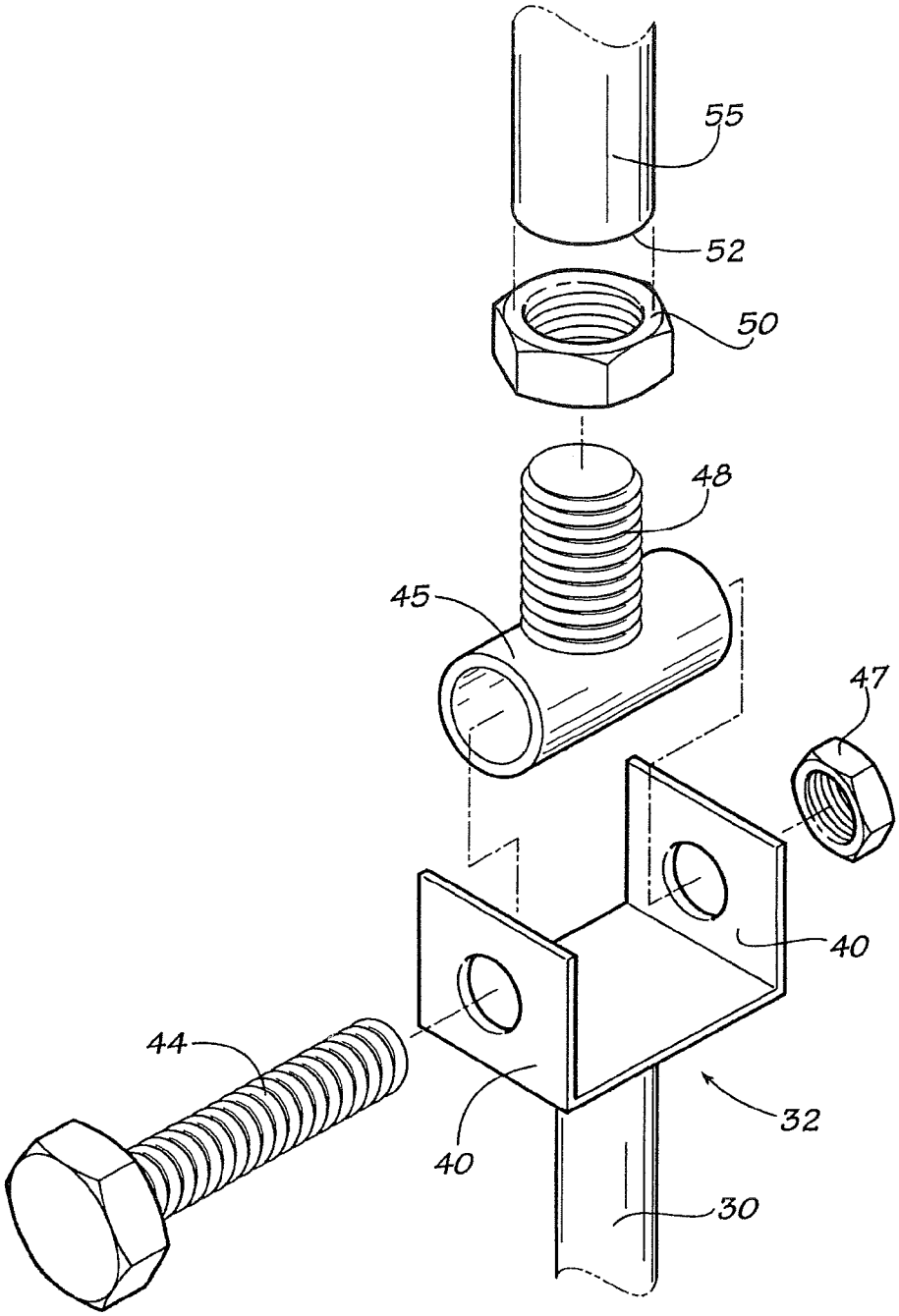
FIG. 2B illustrates in exploded perspective view features of the anchor pier illustrated in FIG. 2A.

FIGS. 2A and 2B illustrate the anchor pier 14 in detailed side view and detailed exploded perspective view, respectively. A T-member 42 assembles in the connector 32. The T-member 42 assembles with a bolt 44 and a tube member 45 having a threaded leg 46. The bolt 44 extends through one of the openings in the side walls 40, through the tube member 45 and through the opening in the opposing side wall. A nut 47 theadingly engages the threaded end of the bolt 44 to secure the bolt to the connector 32. The leg 46 extends from a medial portion of the tube member 45. The leg 46 is a threaded member welded to the tube member 45. In the illustrated embodiment, the leg 46 extends at a substantially perpendicular angle to a longitudinal axis of the tube member 45. The leg 46 defines a threaded shaft 48 that receives a threaded nut 50. A distal portion of the threaded shaft 48 extends inwardly though an open end 52 of a support or brace tube 54 (shown in cut-away detail).

With continuing reference to FIG. 1, a skirting clip 55 (optional) attaches to the tube 54 (or other suitable portion of the anchor pier) for conventionally attaching to or receiving a connector of a skirting (not illustrated) that covers the opening between the ground 11 and the lower edge of the manufactured building. An angle plate 56 attaches at an opposing end of the brace tube 54. The plate has a base 58 and a side wall 60 that defines an opening 61. The side wall 60 of the plate 56 abuts a portion of the wall 17. A fastener 62, such as a threaded screw or a nail, extends through the opening 61 in the side wall 60 and engages a member such as the joist 13 to secure the brace tube 54 to the manufactured building 10.

FIG. 2A further illustrates an alternate embodiment that includes a cap 64 that attaches to or nests with the connector 32. The cap 64 includes a base 66 and perimeter skirt 68 extending from the base 66. The base 66 connects or attaches to the connector 32, and the skirt 68 extends in a direction towards the distal tip 34. The skirt 68 engages the ground 11 when the anchor pier 14 is driven into the ground, to stabilize the shaft 30 and increase the holding capacity of the helical members 36 in the ground.

It is to be appreciated that larger diameter helix members, multiple helix members, longer length shafts, or combination can be used with the anchor pier of the present invention to achieve higher load holding capacity or for use in less dense soil or ground. The anchor pier and the cap can be made of steel, plastic, or other suitable material. The support or brace tube can be made from metal, plastic, or other suitable pipe, rods, or round or square tubing.

Figure 3:
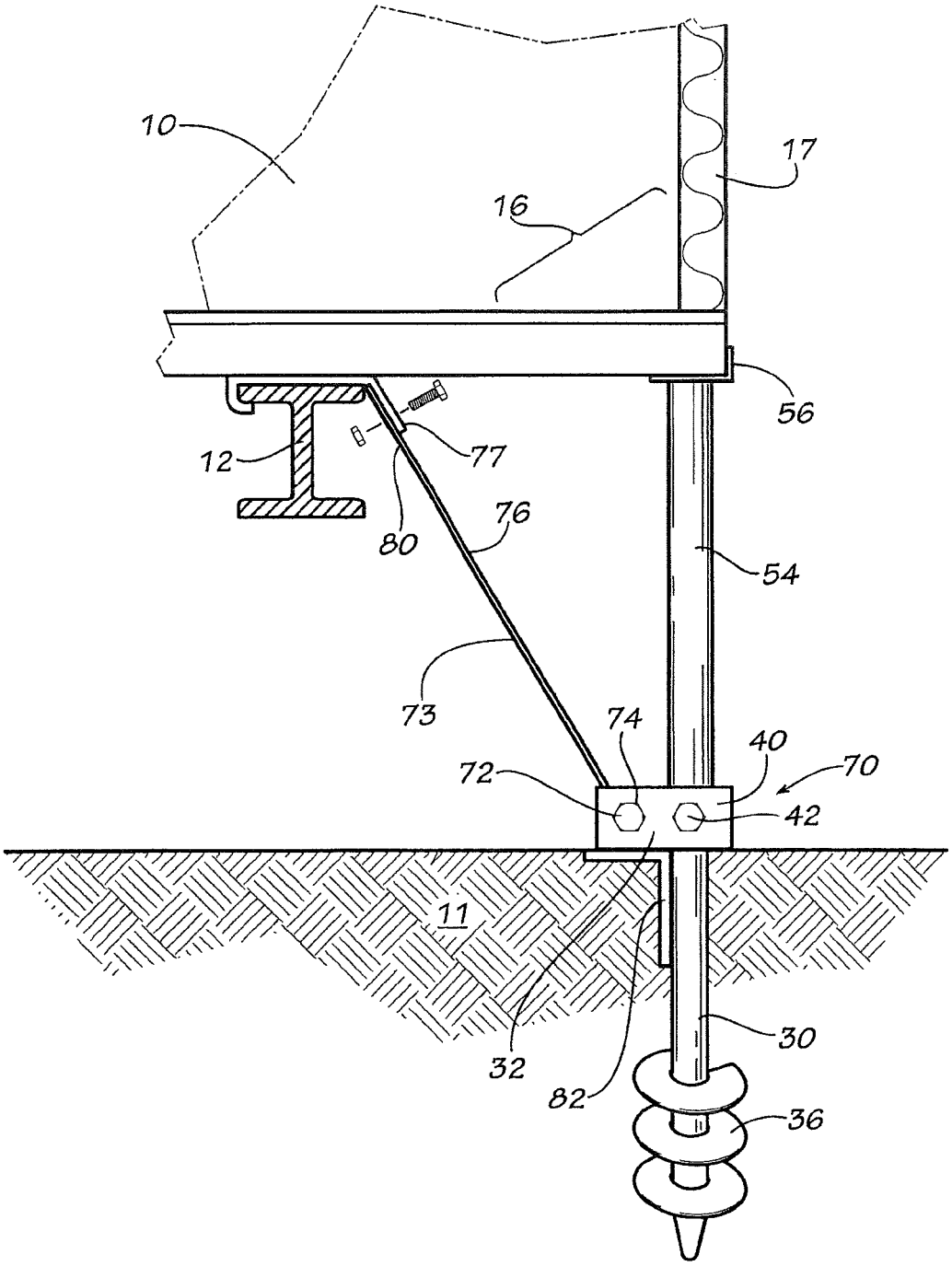
FIG. 3 illustrates in side elevational view a second embodiment of an anchor pier supporting a perimeter portion of a manufactured building and having a connecting member between the anchor pier and a support beam of the manufactured building.

FIG. 3 illustrates in side elevational view a second embodiment of an anchor pier generally 70 supporting the perimeter portion 16 of the manufactured building 10. The anchor pier 70 comprises the structure discussed above for the anchor pier 14 but the side walls 40 define second aligned opposing openings 72. A lateral brace generally 73 connects between the connector 32 and the support beam 12. A bolt extending through the openings 72 secures the lateral brace 73 to the connector 32. In the illustrated embodiment, the lateral brace 73 is a strap 76. The strap connects to a split bolt 74 that extends through the openings 72. A split bolt has a longitudinal slot extending through the shaft of the bolt from an end that receives a nut. An end portion of the strap 76 extends into the slot of the split bolt until flush with the opposite side of the bolt. The bolt is then turned to wind the end portion of the strap around the bolt (such as 4 or 5 complete turns). A nut threaded on the end of the bolt tightens the bolt to the connector 32. An opposing distal end 80 of the strap 76 connects with a frame clamp 77 to the support beam 12. Suitable frame clamps are disclosed in U.S. Pat. Nos. 6,928,783 and 6,418,685. An alternate embodiment uses a telescoping tubular brace to connect between the connector 32 and the support beam 12. U.S. Pat. No. 6,634,150 discloses a telescoping brace assembly and beam connector that can be used with the anchor pier 70 instead of the strap 76. In this embodiment, an angle plate 82 seats against a lower portion of the connector 70 during installation. The plate 82, similarly to the cap 64, provides additional stabilizing support for the anchor pier. The plate 82 is positioned during installation of the connector 70.

Figure 4A:
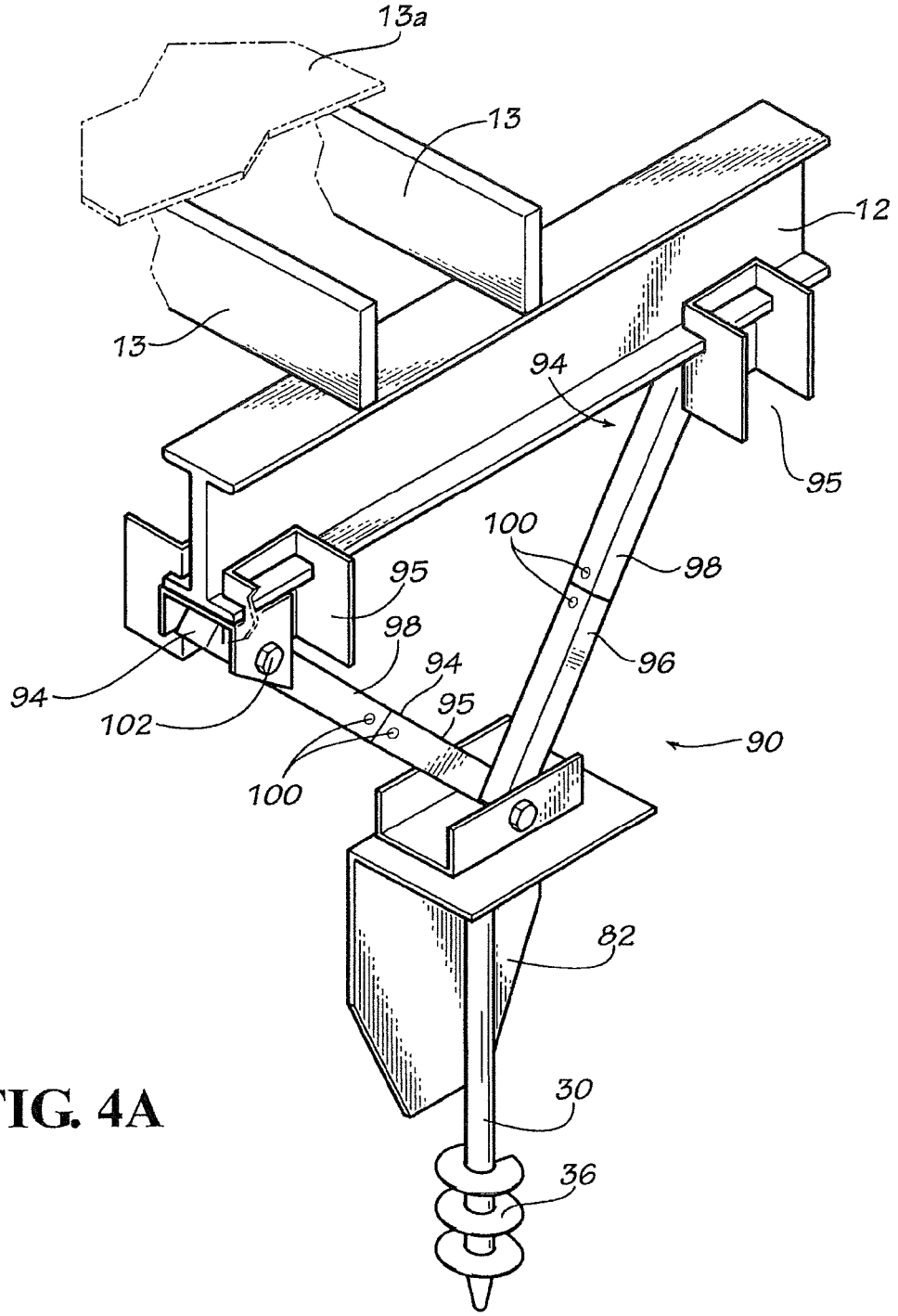
FIG. 4A illustrates in side perspective view a third embodiment of an anchor pier in accordance with the present invention positioned for transferring a load from the support beam of the manufactured building to the ground.

FIG. 4A illustrates in side perspective view a third embodiment of an anchor pier 90 in accordance with the present invention positioned for transferring load (compression or tension) between the support beam 12 of the manufactured building 10 and the ground. The anchor pier 90 includes the connector 32 that engages a pair of opposing braces 94 extending in opposing directions and towards the support beam 12 of the manufactured building. The braces 94 each define openings in respective end portions. The bolt 44 extends through one opening in the side wall 40, through the opening in a first of the braces, through the opening in the second of the braces, and through the opening in the opposing side wall 40. The nut 47 (not illustrated in FIG. 4A) secures the braces 94 to the connector 32. The pair of braces 94 thereby pivotably connects to the connector 32.

The braces 94 also connect at a respective opposing end to a clamp generally 95 attached to the support beam 12. U.S. Pat. No. 7,140,157 discloses a suitable beam clamp 95 for connecting an upper end of the brace 94 to the support beam 12. In an alternate embodiment (not illustrated), the connector 32 includes a pair of openings on each side wall 40, and the braces 94 connect with separate bolts 44 extending through a respective pair of openings on the opposing side walls.

In the illustrated embodiment, each brace 94 comprises a pair of telescoping tubular members 96, 98 fastened at a selected length with threaded fasteners 100. It is to be appreciated that in an alternate embodiment, a unitary tubular member is used.

The clamp 95 attaches to the support beam 12. The clamp 95 defines openings for receiving a threaded pin 102, such as a bolt and nut. An opposing end of the brace 94 defines opposing openings. The pin 102 extends through the aligned openings in the connector 102 and the brace 94 for pivotably connecting the brace 94 to the clamp 95, and thus to the support beam 12.

Figure 4B:
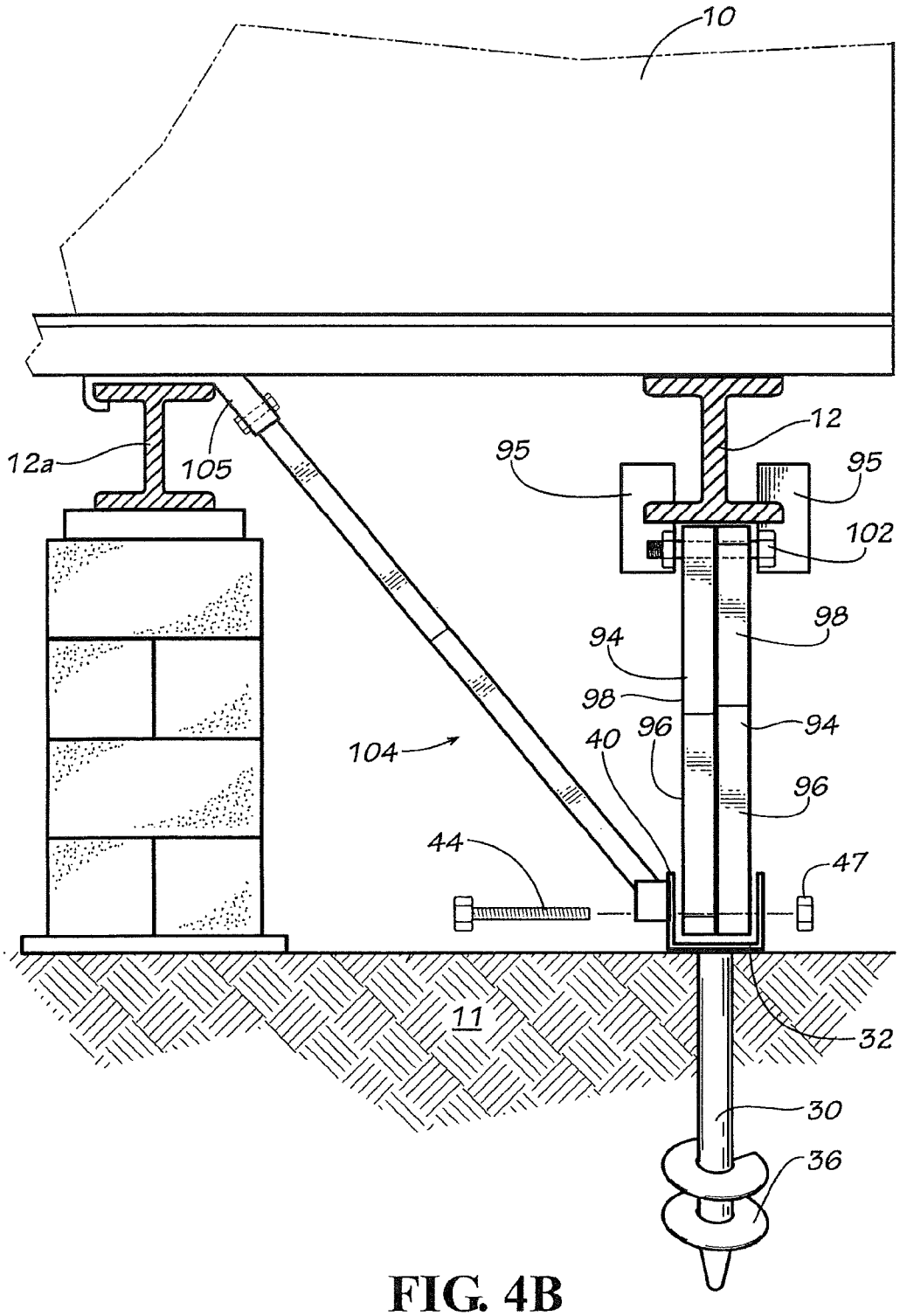
FIG. 4B illustrates in side view an alternate embodiment of the anchor pier illustrated in FIG. 4A.

FIG. 4B illustrates in side view an alternate embodiment of the anchor pier illustrated in FIG. 4A, to provide also both lateral and longitudinal load resistance. A third brace 104 assembled with telescoping tubular members extends between the connector 32 and a laterally spaced support beam 12*a*. The brace 104 pivotably attaches at a lower end to the connector 32 with a bolt 44 as discussed above, which bolt extends through second opposed openings in the side walls 40. The brace 104 pivotably attaches at an upper end to a beam connector 105 attached to the beam. U.S. Pat. No. 6,634,150 describes a suitable beam connector that generally includes a bracket and retaining means. The bracket includes a traversing portion traversing an outer surface of a flange of second beam 12*a*. The traversing portion includes a first end and a second end. The bracket includes a slot with a first side for bearing against an inner surface of the flange, a second side, which may be part of traversing portion, for bearing on outer surface of the flange, and an end for bearing on a free end of the flange.

Figure 5:
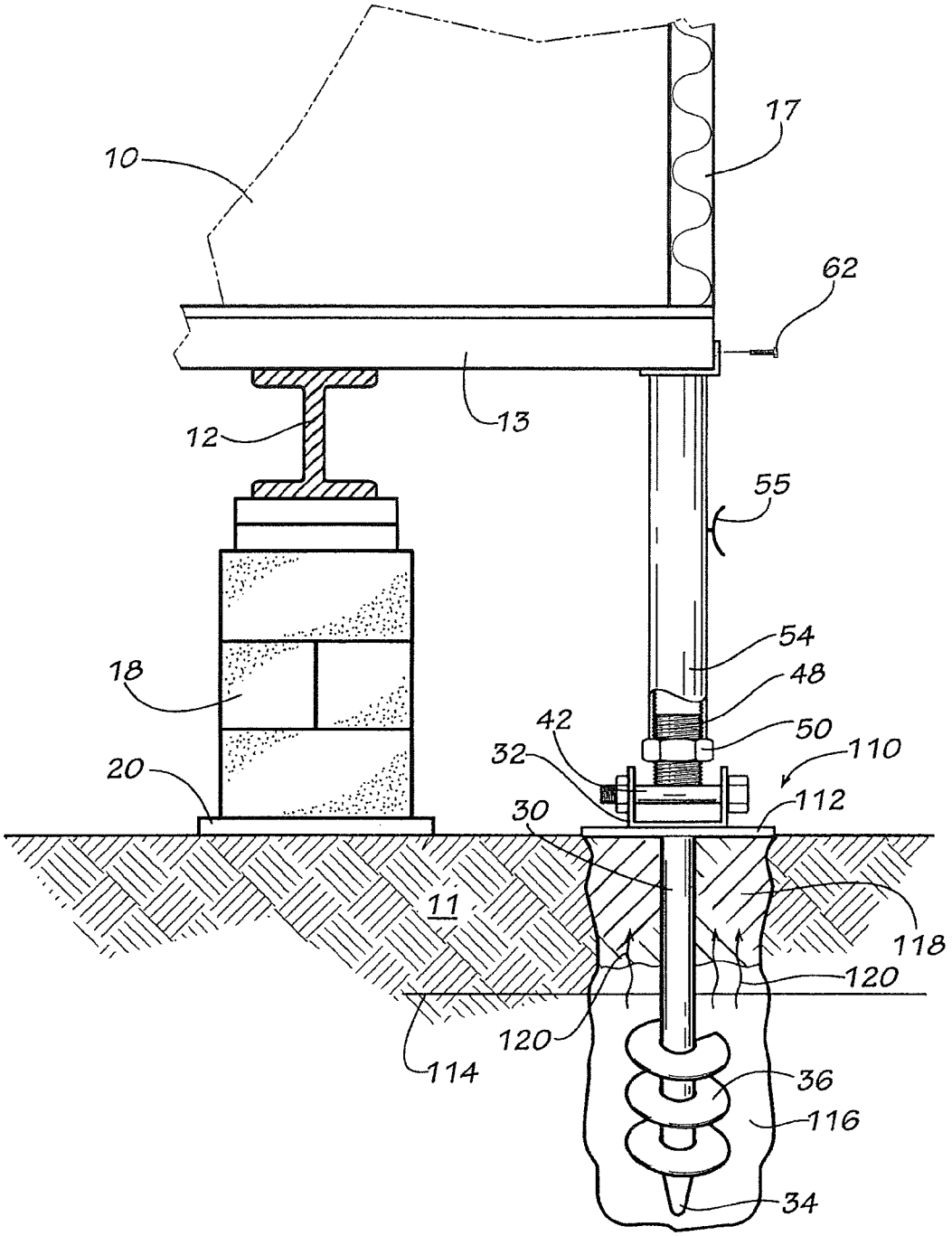
FIG. 5 illustrates in side elevational view an alternate embodiment of the anchor pier illustrated in FIG. 1 further including a thermal isolator member for resisting frost heave of the ground in accordance with the present invention.

FIG. 5 illustrates in side elevational view an alternate embodiment of an anchor pier 110 that further includes a thermally insulative member 112 disposed between the connector 32 and the ground 11. The insulative member 112 resists frost heave of the ground when stabilizing upwardly against the manufactured building or the building needs additional support members. The thermally insulative member 112 may be a foam sheet such as a STYROFOAM panel or sheet, or in an alternate embodiment, a metal plate to which a thermally insulative member or material attaches.

For example, the thermally insulative member is defined by a spray-on thermal material which sticks or attaches to the plate. The thermally insulative member 112 provides a thermally insulative layer or coating of between about ¼ inch to ½ inch, or other thickness suitable for restricting thermal communication, as discussed below. In this embodiment, the tip 34 of the shaft 30 is driven into the ground 11 deeper than a frost line 114. The helix portion 36 of the below the frost line 114 transfers the load from the manufactured building to the ground, for use of the anchor as a pier.

The thermally insulative member 112 defines in situ a ground column generally 116 that is substantially coaxially aligned with shaft 30 and a thermally isolated ground column 118 proximate the connector 32. The ground column 116 below the frost line 114 communicates (generally 120) ground heat into the proximate thermally isolated ground column 118.

Figure 6:
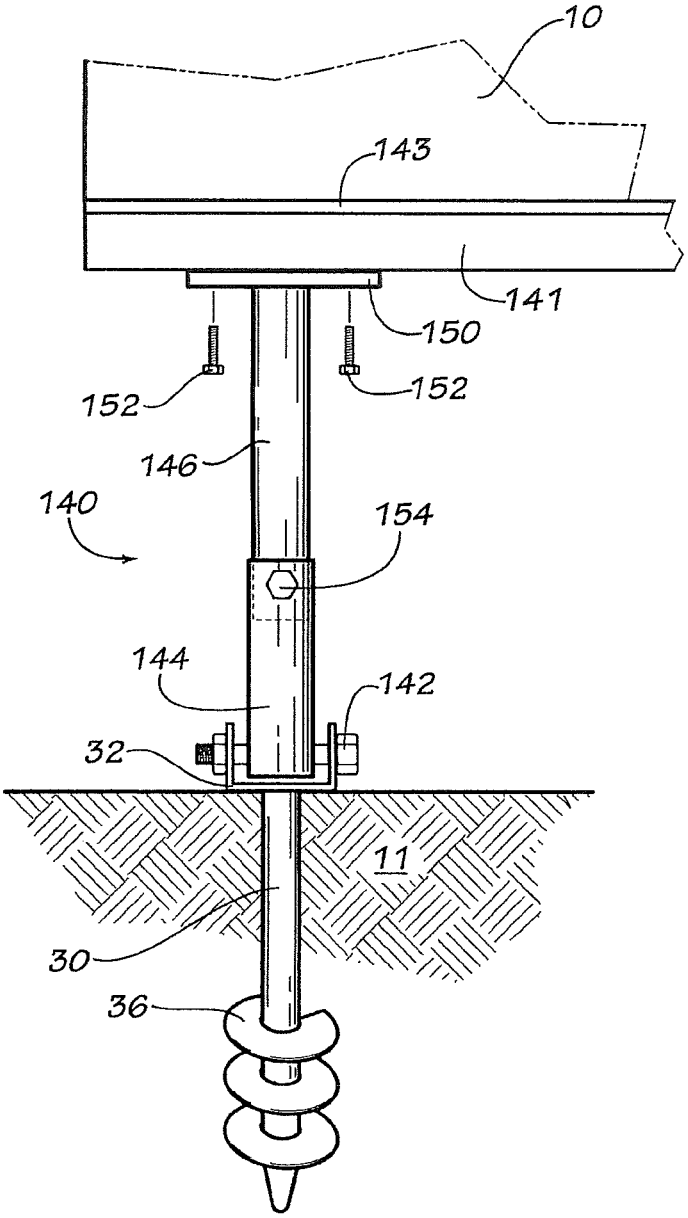
FIG. 6 illustrates in side elevational view a fourth embodiment of an anchor pier in accordance with the present invention.

FIG. 6 illustrates a side elevational view of a fourth embodiment of an anchor pier 140 positioned for transferring load between the manufactured building 10 and the ground 11 by connecting to one of a plurality of joists 141 that support a floor 143 of the manufactured building. The anchor pier 140 includes the connector 32 with the shaft 30 and helical members or flights 36 for embedding in the ground 11. A bolt 142 extends through openings in the opposing side walls 40 of the connector 32. A brace generally 140 attaches to the connector 32 and to the floor joist 141 of the manufactured building. In the illustrated embodiment, the brace 140 has a first tube 144 and a second tube 146 which telescope together. The first tube 144 includes opposing holes at a first end. The bolt 142 extends through the holes to secure the lower end of the first tube 144 to the connector 32. A plate 150 attaches to an end of the second tube 146. The free end of the first tube 144 slidingly receives the free end of the second tube 146. Screws 152 secure the plate 150 to a floor joist of the manufactured building. A fastener 154, such as a screw or a bolt, connects the first and second tubes 146, 148 together. An alternate embodiment uses the T-member 42 illustrated in FIGS. 2A and 2B with the connector 32. The threaded leg 46 receives the open end of the lower tube 144. However, it is to be appreciated that the tubes 144, 146 with the bolt 142 may gainfully be use with the embodiment illustrated in FIG. 5 for compression/tension load support.

Figure 7:
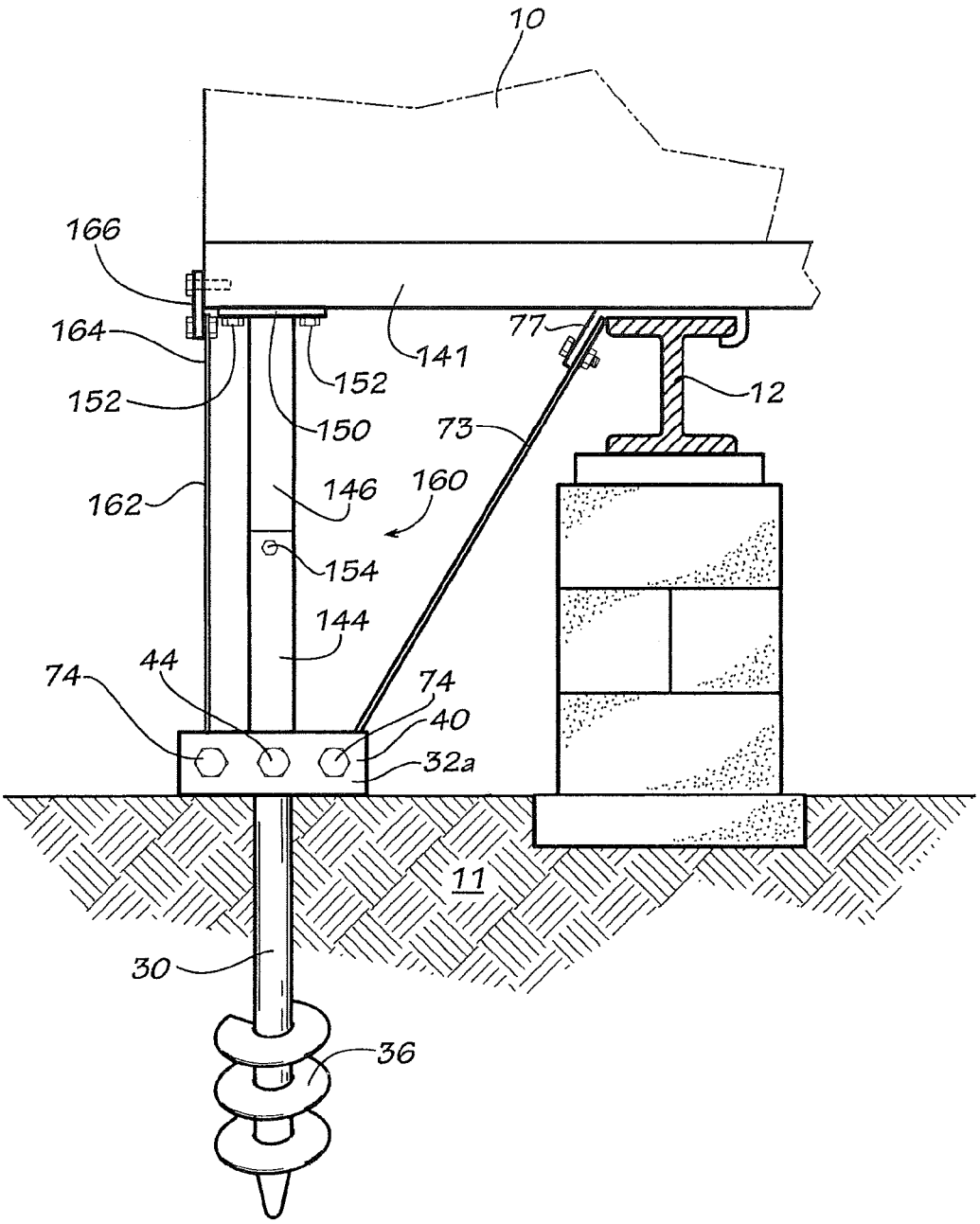
FIG. 7 illustrates in side elevational view a fifth embodiment of the anchor pier in accordance with the present invention.

FIG. 7 illustrates in side elevational view a fifth embodiment of an anchor pier 160. In this embodiment, the connector 32*a* includes three spaced openings in each side wall 40. The brace 140 illustrated in FIG. 6 connects between the floor joist 141 and the connector 32*a* of the anchor pier 160. The anchor pier 160 also includes a strap 162 that attaches to the connector 32 with the split bolt 74 discussed above. An opposing end 164 of the strap 162 attaches to the manufactured building or rim joist, such as with a clip 166 that secures with fasteners to the side wall or end of the floor joist or rim joist. The lateral brace 73 (discussed above with reference to the embodiment illustrated in FIG. 3) connects to the connector 32*a* and to the frame clamp 77 on the support beam 12.

Figure 8A:
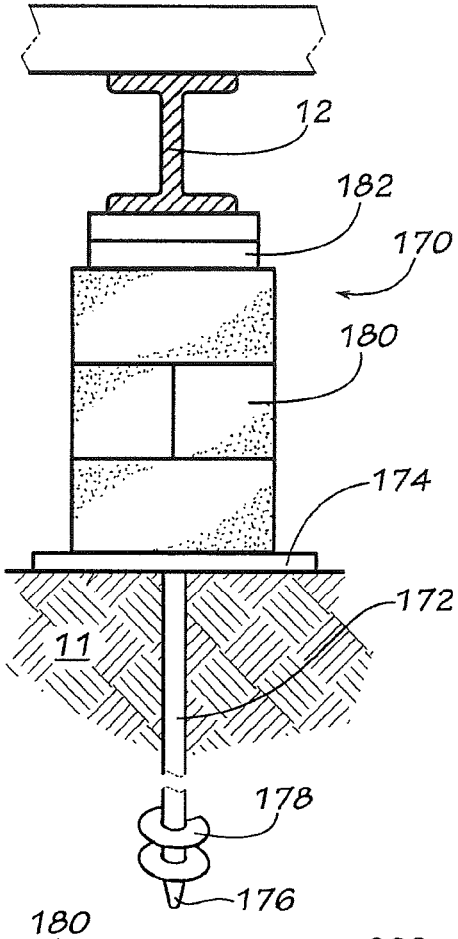
FIG. 8A illustrates in side elevational view a sixth embodiment of the anchor pier in accordance with the present invention.

FIG. 8A illustrates in side elevational view a sixth embodiment of an anchor pier 170. The anchor pier 170 includes a shaft 172 having a plate 174 attached at a first end and a distal tip 176 at an opposing end. Helical members 178 attach in spaced-apart relation to the shaft near the distal tip 176. The anchor 170 is received in the ground 11 so that the plate 174 sits flush on the surface of the ground. A plurality of blocks 180, such as conventional cement block, sit as a stack or pier on the plate 174 beneath the support beam 12. Wood boards 182 or other spacers position between the upper end of the pier and the lower surface of the support beam 12 to wedgingly contact the support beam with the pier.

Figure 8B:
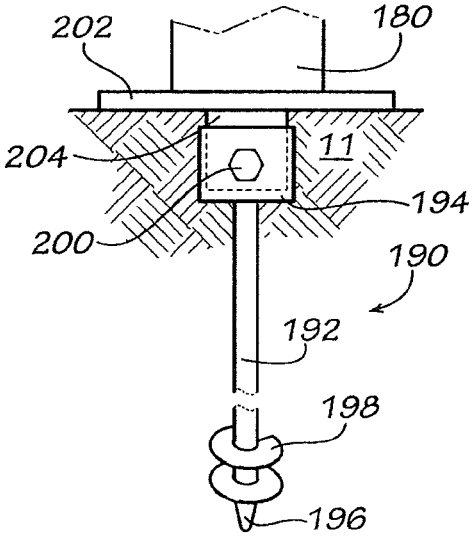
FIG. 8B illustrates in side elevational view a seventh embodiment of the anchor pier in accordance with the present invention.

FIG. 8B illustrates in side elevational view a seventh embodiment of an anchor pier 190. The anchor pier 190 includes a shaft 192 having a connector member 194 at a first end and a distal tip 196 at an opposing end. Helical members 198 attach in spaced-apart relation to the shaft 192. The connector member 194 attaches to the upper end of the shaft 192. The connector member 194 defines an opening for a bolt 200. The anchor pier 190 includes a plate member 202. A mating member 204 attaches to the plate 202. The connector member 194 receives the member 204. The bolt 200 extends through the aligned openings of the members 194, 204, to rigidly connect the plate member to the anchor pier 190. The connector member 194 and the mating member 204 are made of tubes (such as a box tube or round tube), or channel members.

Figure 8C:
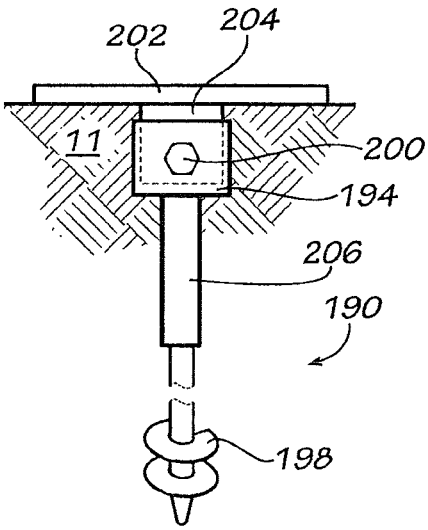
FIG. 8C illustrates in side elevational view an alternate embodiment of the anchor shown in FIG. 8B.

FIG. 8C illustrates an alternate embodiment of the anchor pier 190*a*. In this embodiment, a sleeve 206 attaches to a lower surface of the connector member 194, through which the shaft 192 extends. The sleeve 206 provides additional lateral support to the anchor pier 190 when it is driven into the ground 11.

Figure 9:
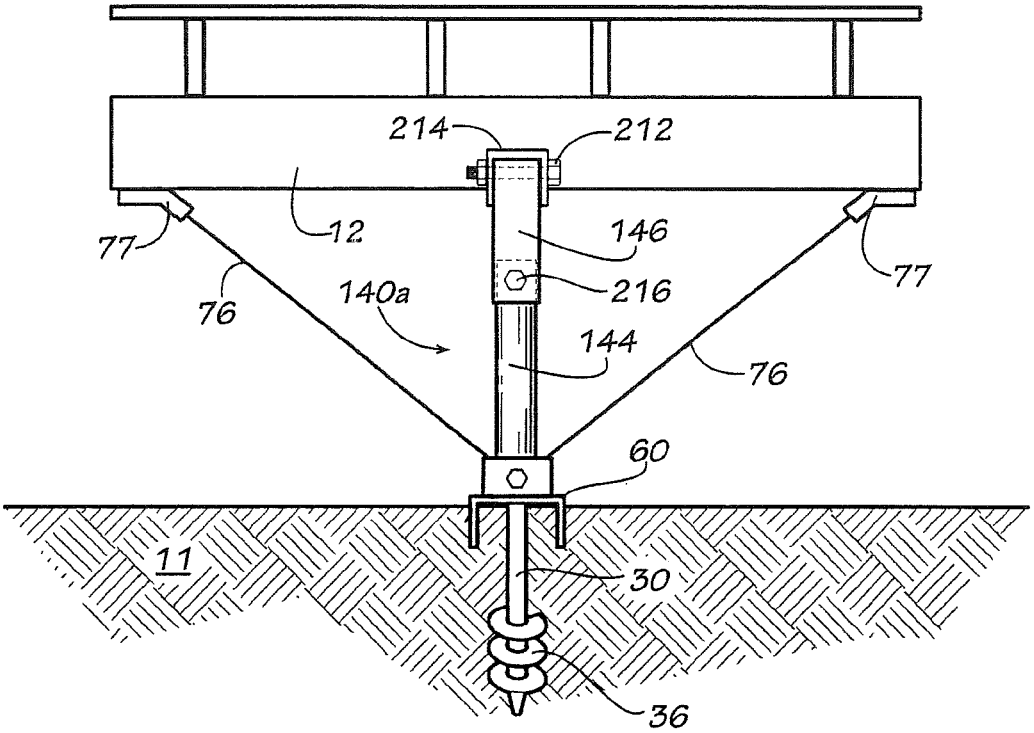
FIG. 9 illustrates in side elevational view an eighth embodiment of the anchor pier in accordance with the present invention.
Figure 10:
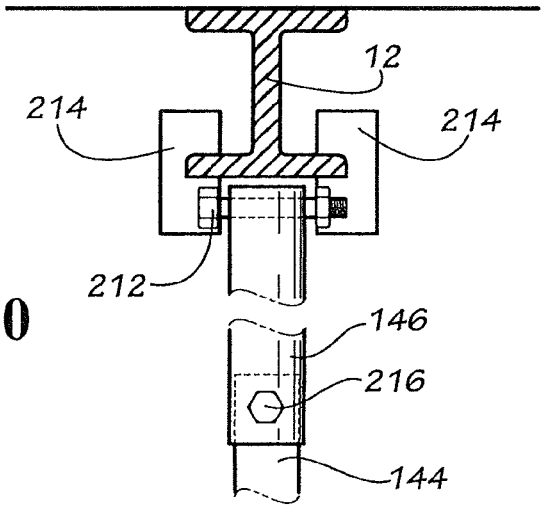
FIG. 10 illustrates in side elevational view a detailed view of the anchor pier illustrated in FIG. 9.

FIG. 9 illustrates in side elevational view an alternate embodiment 140*a* of the anchor pier 140 illustrated in FIG. 6. FIG. 10 illustrates in side elevational view a detailed view of the anchor pier illustrated in FIG. 9. In this embodiment, the second tube 146 does not include the plate 150. Rather, the free end of the tube 146 defines opposed openings that receive a bolt 212. The bolt 212 extends through openings defined in connectors 214 that connect to opposing free flanges of the I-beam 12. Also, in this illustrated embodiment, the diameter of the second tube 146 exceeds the diameter of the first tube 144. The second tube 146 telescopingly receives an end portion of the first tube 144. Each tube 144, 146 defines at least one pair of opposed openings for receiving a threaded fastener 216 such as a bolt. The fastener 216 secures the tubes 144, 146 together. Further, opposing straps 76 (discussed above) extend between the connector 32 and the frame clamp 77. The anchor pier 140*a* transfers loading between the ground and the manufactured building and the straps 76 resist opposing longitudinal forces.

Figure 11:
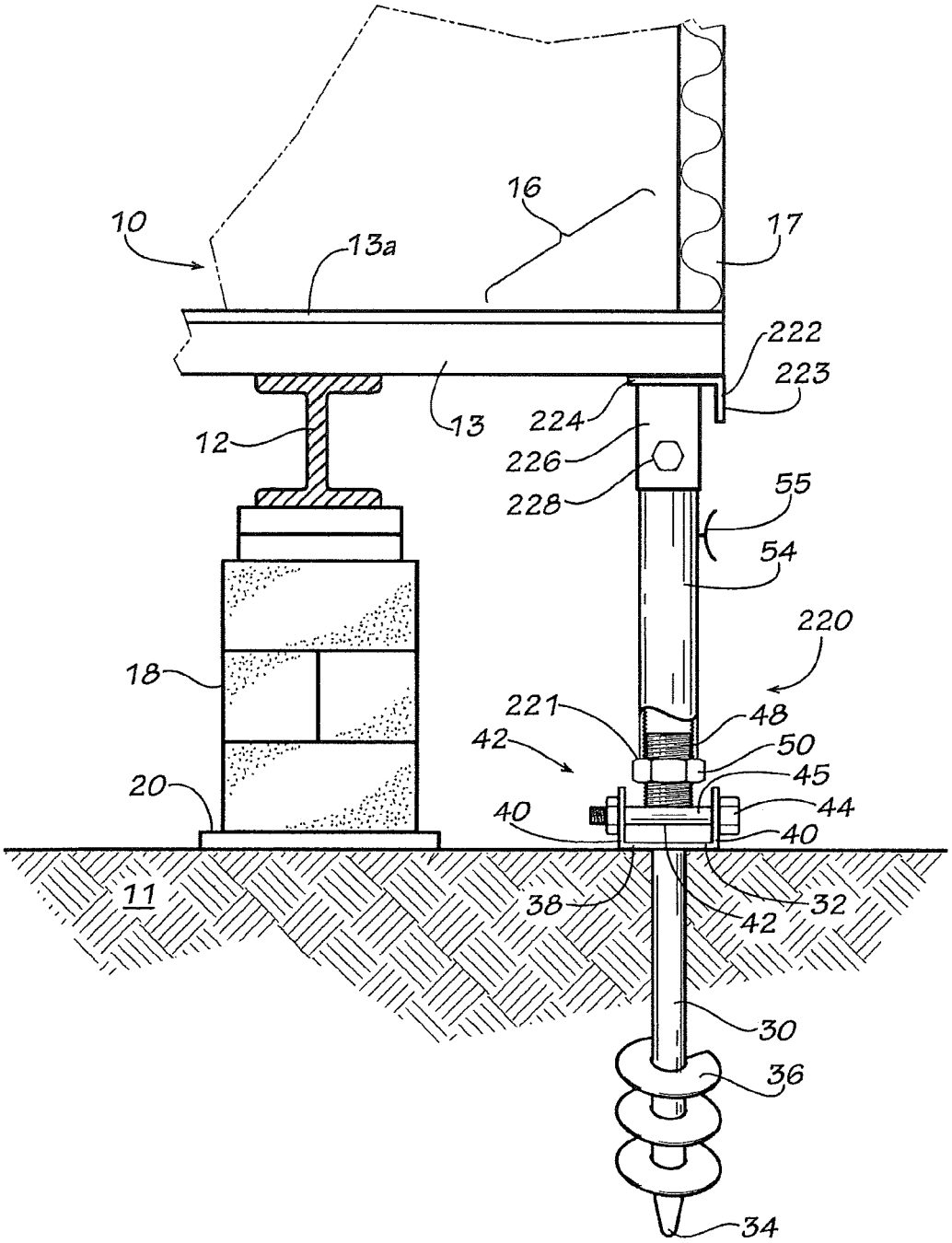
FIG. 11 illustrates in side elevational view a ninth embodiment of the anchor pier in accordance with the present invention.
Figure 12:
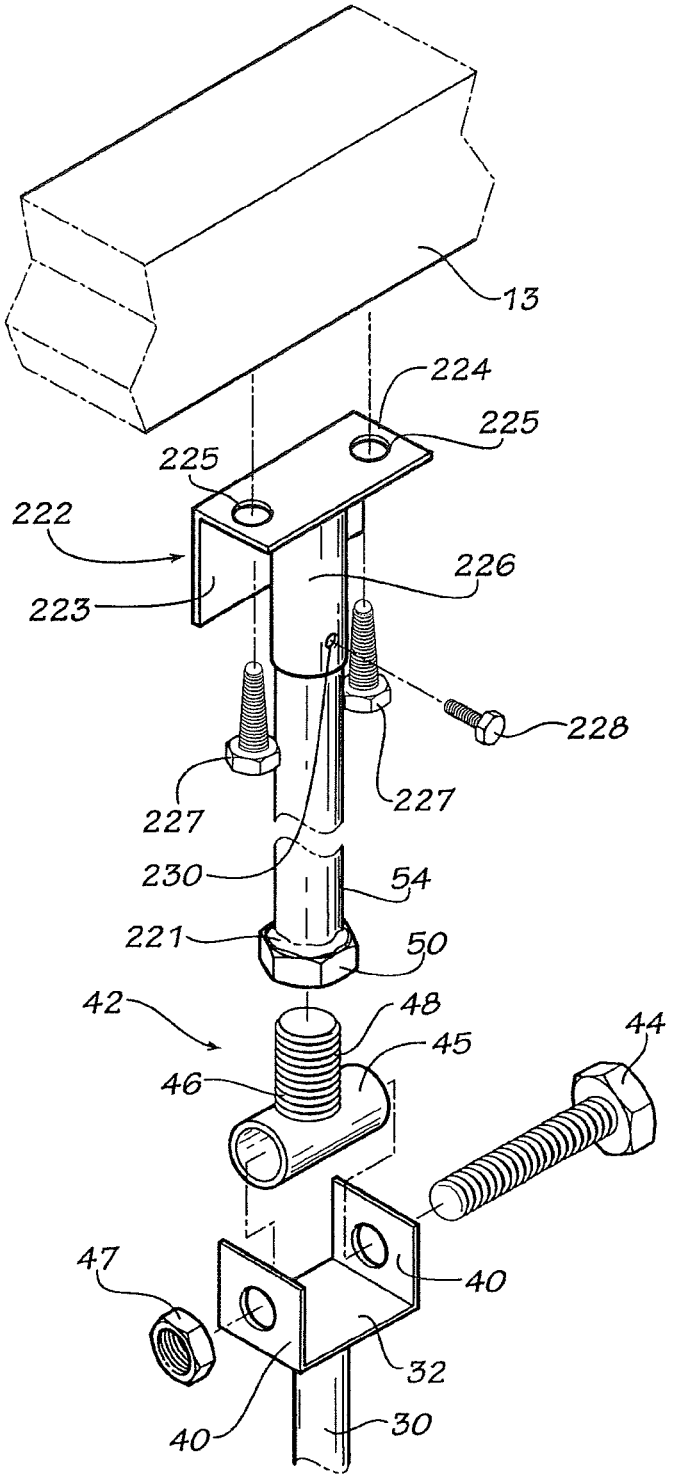
FIG. 12 illustrates a perspective exploded view of the anchor pier shown in FIG. 11.

FIG. 11 illustrates in side elevational view a ninth embodiment of an anchor pier 220 in accordance with the present invention. FIG. 12 illustrates the anchor pier 220 in a perspective exploded view. With reference to FIG. 11, the anchor pier 220 is positioned at an outward edge of the manufactured building 10 and spaced apart from the pier 18 beneath the support beam 12. The anchor pier 220 transfers load between the manufactured building 10 and the ground 11 by connecting to one of a plurality of joists 13 that support the floor 13*a* of the manufactured building.

The anchor pier 220 includes the support tube 54 that couples with the connector 32 through the T-member 42 and a connector 222 that attaches to a joist of the manufactured building 10. In this embodiment, the nut 50 welds 221 to the lower end of the tube 54, as best illustrated in FIG. 12. The assembly of the tube 54 and the nut 50 then rotates onto the threaded shaft 48 of the T-member 42 during installation at the site.

The connector 32 includes the shaft 30 and helical members 36 far embedding in the ground 11. The connector 32 engages the T-member 42 with the bolt 44 extending through the opening in one of the sidewalls 40 in the connector 32, though the tube member 45, and through the opening in the opposing sidewall 40. The nut 47 threads on the bolt 44 and thus secures the T-member 42 to the connector 32. The threaded leg 46 of the T-member 42 receives the assembly of the nut 50 and the tube 54. A distal portion of the threaded shaft 48 extends inwardly though the open end 52 of the support tube 54 as the nut 50 threads onto the shaft 48.

The support tube 54 attaches through a connector 222 to the joist 13. The connector 222 is an angle member with a side face 223 and top plate 224 that defines a pair of spaced-apart openings 225. Fasteners 227 extend through the openings 225 to attach the connector 222 to the joist 13. A receiving member 226 attaches to the interior portion of the angle member. The receiving member 226 is a length of tube sized to receive a distal end portion of the support tube 54. Fasteners 228 extend through respective opposed openings 230 (one is illustrated) in the receiving member 226 to rigidly connect the support tube 54 to the connector 222. As best illustrated in FIG. 1, the connector 222 is disposed to position the side face 223 in alignment with a side of the manufactured building 10. Skirting (not illustrated) that covers the opening between the ground 11 and the lower edge of the manufactured building can attach to the side face 223. The support tube 54 also can include the skirting clip 55 (optional) for attaching skirting.

In the illustrated embodiment, the anchor pier 220 uses a 1 inch or 1 and ¼ inch diameter, 42 inch long, 12 gauge round tube. The length can be selected based on the particular installation site. The receiving member 226 is a 1 and ¼ inch or 1 and ½ inch round tube, 11 gauge, having a length of 3 inches. The tube member 45 in the T-member 42 is a 1 inch round tube having a length of 1 and ⅝ inches. The threaded member 46 is 10 inches in length. The fastener 44 is a ⅝ inch by 2 and ¾ inch grade 2 bolt using a ⅝ inch nut. The fasteners 227 are ⅜ inch lag screws having a 3 inch length. The fasteners 228 are ¼ inch—14 self-tapping screws having a ¾ length. The connector 222 is an angle member of 0.120 inch thickness. Depending on particular installation and engineering requirements, variations may be made.

In an alternate embodiment, the support tube 54 is a pair of telescoping members such as the members 96, 98 illustrated in FIG. 4B or the members 146, 148 illustrated in FIG. 6. This alternate embodiment pins the lower end of one of the members to the connector 32 with a fastener 142 and does not use the T-member 42. The other of the telescoping members is received by the receiving member 226 of the connector 222. The telescoping members adjust the overall length between the ground 11 and the connector 222 during installation as discussed below. Fasteners rigidly connect the installed telescoping members together.

Another alternate embodiment does not use the nut 50/tube 54 assembly or the T-member 42. In this embodiment, a fixed length member is used for the support tube 54. The length is selected for being received in the receiving member 226 during installation yet sufficient to extend between the connector 32 and the connector 222. A lower end of the fixed length member defines opposing openings. The fastener 142 extends through the side wall 40 of the connector 32, through the lower end of the fixed length member, and through the opposing side wall. the receiving member 226 provides a gap between the upper edge of the member inserted into the receiving member and the top plate 224 to facilitate installation. In this embodiment, the connector 222 receives the upper end of the fixed length member. The connector 222 is moved against the joist 13 and attached to the joist with the fasteners 227. This movement defines a gap between the upper edge of the fixed length member and the top plate 224. The fasteners 228 secure the fixed length tube to the receiving member 226.

Figure 13:
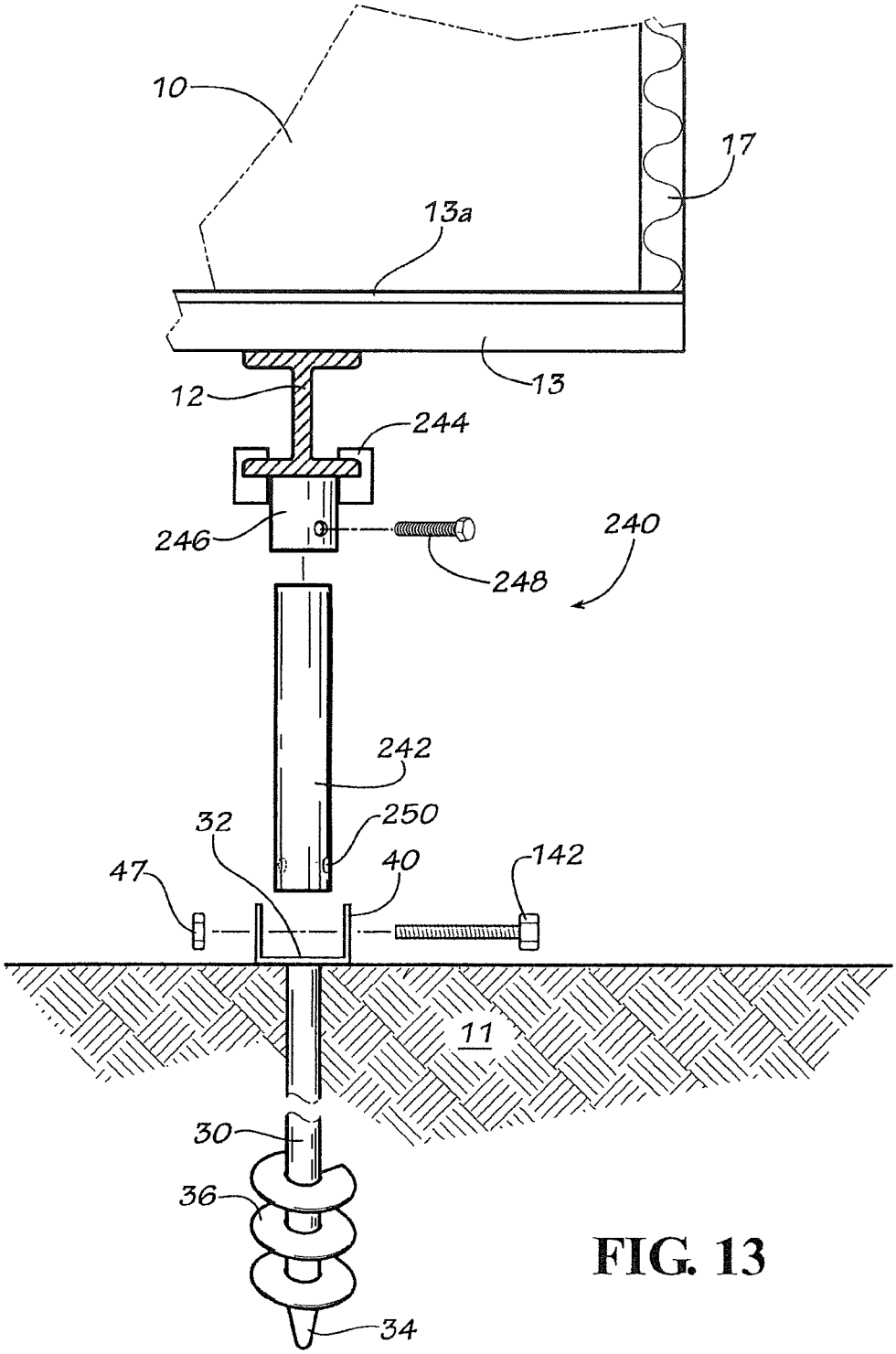
FIG. 13 illustrates an alternate embodiment of the anchor pier illustrated in FIG. 12.

FIG. 13 illustrates other alternate embodiment with an anchor pier 240 having a support tube 242 that connects with the connector 32 to the ground 11 and connects with a connector 244 to one of the support beams 12. The connector 244 is similar to the connector 214 discussed above but includes a receiver member 246. The receiver member 246 attaches to one of the flange portions of the connector 213 such as by welding. Alternatively, a bolt extends between the flange portions of the connector 244 and through openings in the receiver member 246. The receiver member 246 receives an end of the support tube 242. A fastener 248 secures the support tube 242 to the receiver member 246. In the illustrated embodiment, a lower end of the support tube 242 defines opposing openings 250. The openings 250 receive the bolt 142 for securing the support tube to the connector 32. An alternate embodiment however uses the assembly of the nut 50 and support tube 54, that couple with the T-member 42 to the connector 32 as discussed above.

The operation of the anchor pier for use in supporting manufactured buildings in various embodiments is discussed below. The anchor pier holds the manufactured building for both compression (building mass pushing down on the anchor pier) forces between the building and the ground and in some embodiments also tension forces in which the building tends to lift upwardly. The helical members of the connector (such as connector 32) functions as a pier in supporting the manufactured building, and installed below a frost line resists frost heave forces. With reference to FIGS. 1 and 2, the anchor pier provides compression or downward load support to perimeter portions 16 of manufactured buildings 10. The anchor pier 14 is driven in to the ground 11 in alignment with the exterior wall 17. This is accomplished with a power driver or lever for rotating the shaft 30 to drive the tip 34 into the ground with the helical thread member 36. The nut 50 threads on the leg 46. The brace tube 54 is aligned vertically with the leg 46 and the open end 52 receives the threaded portion of the leg 42. The perimeter wall of the brace tube 54 contacts the nut 50. The brace tube 54 is aligned so that the plate 56 is positioned with the side wall 60 outwardly of the wall 17 of the perimeter portion 16 of the manufactured building. The nut 50 is rotated on the threaded leg 46. This moves the brace tube 54 vertically towards and into forcing contact with the lower surface of the joist on the exterior wall. The fastener 62 extends through the opening in the side wall 62 and into the end of the joist. The anchor pier 14 then transfers loading from the manufactured building to the ground.

With reference to FIG. 3, the anchor pier 70 further provides for resisting lateral forces on the manufactured building by use of opposing installed pairs of anchor piers 70 positioned on opposing sides of the manufactured building. The lateral brace 73 connects between the connector 32 and the support beam 12. In the embodiment using the straps 76, the strap on the windward side resists lateral loading by wind forces directed against the wall 17.

With reference to FIG. 4, the opposing braces 94 in the anchor pier 90 resist longitudinal forces on the manufactured building while the anchor pier 90 communicates loading of the manufactured building to the ground.

With reference to FIG. 5, the anchor pier 110 according to the present invention reduces movement caused by frost heave arising from the freezing and thawing of moistureladen ground engaged by the shaft 30. The cap 60 or plate 82 provides additional load resistance and building support to the helical anchor that operates as a pier. The ground heat communicates 120 through and from the ground column 116 and into the proximate thermally isolated ground column 118. The thermally insulative member 112 received on the shaft 30 caps the ground column and restricts heat communication from the proximate thermally isolated ground column 118 to and through the connector 32 to the atmosphere. The proximate thermally isolated ground column 118 retains ground heat, and the proximate ground thermally isolated column 118 experiences reduced freezing occurrences (compared to nearby portions of the proximate ground between the ground surface and the portion of the ground below the frost line 114). As a consequence, the occurrence of frost heave is reduced relative to the proximate thermally isolated ground column 118, and movement of the anchor pier is thereby reduced. The thermally insulative member 112 provides a high resistance to heat communication (generally referred to in the insulating trade as an R factor) over an anchor installation lacking the member. It is to be appreciated the thermally insulative member 112 may gainfully be used with the anchor piers disclosed herein, including the anchor pier 14, 70, and 90.

With reference to FIG. 6, the anchor pier 140, with the helical member 36 engaged in the ground 11, transfers load between the support beam 12 of the manufactured building 10 to the ground 11. After drilling the shaft 30 into the ground, the bolt 142 secures the first tube 144 to the connector 32 by extending through the opening in one side wall 40, through the opposing openings in the end of the tube 144, and through the opening in the opposing side wall 40. The tube 144 receives the tube 146. The tube 146 is raised to position the plate 150 against the floor joist and is secured thereto with the fasteners 152. The fastener 154 connects the first and second tubes 144, 146 together. During use, the connected tubes 144, 146 transfer vertical loading forces between the manufactured building and the ground 11.

The embodiment illustrated in FIG. 7 includes the brace 144 having connected tubes 144, 146 for vertical loading. The strap 162 installs to the connector 32 with the split bolt 74. After attaching the opposing end 164 of the strap 162 to the clip 166 attached to the manufactured building, the head of the split bolt 74 is rotated to tighten the strap. Upon tensioning of the strap, the split bolt is secured with a nut to hold the strap 162 in tension. The lateral brace 73 attaches between the connector 32 and a lateral support beam 12 as discussed above with reference to the embodiment illustrated in FIG. 3. The strap 162 and brace 73 provide additional longitudinal and/or lateral wind and/or seismic load resistance.

The anchor pier 170 shown in FIG. 8A provides vertical load support for the manufactured building as a pier. The shaft 172 is driven into the ground 11 to embed the helical member 178, until the plate 174 sits flush on the surface of the ground. The blocks 180 stack as a pier and wood boards 182 or other spacers wedge firmly between the uppermost block in the pier and the support beam 12. The anchor pier 170 transfers the vertical load of the manufactured building to the ground 11.

The anchor pier 190 shown in FIG. 8B similarly supports a pier such as tube members or blocks 180. The mating member 204 received in the connector 194 also connects to the connector 194 with the bolt 200. Upon installing the pier (blocks 180 on the plate 202 with the wedge boards 182 against the support beam 12 as illustrated in FIG. 8A), the anchor pier 190 transfers vertical loading from the manufactured building to the ground 11.

FIG. 8C illustrates an alternate embodiment of the anchor pier 190. The sleeve 206 provides additional lateral support to the anchor pier 190 when it is driven into the ground 11.

FIG. 9 illustrates in side elevational view an alternate embodiment anchor pier 140*a* of the anchor pier 140 illustrated in FIG. 6. FIG. 10 illustrates a side view of the alternate embodiment anchor pier 140*a*. In this embodiment, the second tube 146 connects with the bolt 212 extending through the opposed openings and extends through openings defined in the connectors 214 that connect to opposing free flanges of the I-beam 12. The fastener 216 secures the tubes 144, 146 together. The anchor pier 140*a* transfers loading from the manufactured building to the ground. The opposing straps 76 between the connector 32 and the frame clamp 77 resist opposing longitudinal forces.

The anchor pier 220 illustrated in FIGS. 11 and 12 provides load support for both downward loads imposed by the manufactured building 10 to the ground as well as upload forces because the support tube 54 is fastened through the connector 32 to the ground by the helix members 36 and is fastened to the manufactured building through the connector 222. During installation, the connector 32 is driving into the ground to fix the helix member 36 in the ground. The T-member 42 is attached to the connector 32 through the fastener 44 extending through the tube 45. The assembly of the nut 50 and support tube 54 threadingly engages the threaded shaft 48 of the leg 46. The distal end of the support tube 54 inserts into the receiving member 226. The connector 222 is aligned with the joist 13. The nut 50 is rotated, and this moves the connector 222 towards the joist 13. The top plate 224 contacts the lower surface of the joist 13. The fasteners 227 extending through the openings 225 secures the connector to the joist 13. The fasteners 228 extending through respective opposed openings 230 rigidly connects the support tube 54 to the connector 222.

After installation, the anchor pier 220 provides support of the manufactured building in response to loading caused by the building and by uplift forces. The anchor pier 220 transfers load between the manufactured building 10 and the ground 11 by the rigid connection of the support tube to the connector 32 and to the manufactured building through the connector 222.

The alternate embodiments of the anchor pier 220 likewise transfers load (downwardly and upwardly) through the rigidly connected telescoping members or the single member of a fixed length.

It is to be appreciated that that the anchor pier 220 may also use the additional support provided by the cap 64 or by the plate 82 discussed above. Installations at sites subject to freezing and frost heave gainfully employ the thermally insulative member 112 disposed between the connector 32 and the ground 11 for defining in situ the ground column 116 and the thermally isolated ground column 118 proximate the connector 32, as illustrated in FIG. 5, with the helical members 36 disposed at depth below the frost line 114.

The anchor pier 240 illustrated in FIG. 13 also provides vertical load support from the loading of the manufactured building as well as uplift loading experienced by manufactured buildings. The connector 32 driven into the ground 11 connects with the bolt 142 to the support tube 242. The upper end of the support tube inserts into and attaches to the receiver member 246 for connecting to the flanges of the support beam 12. The alternate embodiment uses the assembly of the nut 50 and the support tube 54 to connect through the T-member to the connector 32. The anchor pier 240 resists vertical loads in supporting the manufactured building 10. It is to be appreciated that telescoping members or a fixed length member may be gainfully used with the anchor pier 240. The insulative member 112 can also be used for installations at sites subject to freezing and frost heave. The support cap 64 or plate 82 can be used with the anchor pier 240.

The present invention accordingly provides the anchor pier for supporting perimeter and main support beams of manufactured buildings and cooperatively with the thermally insulative member for defining the proximate thermally isolated ground column to cap communication of ground heat therefrom and thereby resist frost heave occurrences proximate the anchor. While this invention has been described in detail with particular references to illustrated embodiments thereof, it should be understood that many modifications, additions and deletions, in additions to those expressly recited, may be made thereto without departure from the spirit and scope of the invention.

What is claimed is:

1. An anchor pier for supporting a manufactured building, comprising:

a shaft having a U-shaped connector having a base attached at a first end of the shaft and a driving tip at an opposing end with at least one helical flight positioned proximate the driving tip, for driving through a surface of ground beneath a manufactured building to position the U-shaped connector proximate the surface, for interaction of the shaft and the helical flight with the ground to communicate vertical loading between the building and the ground;

a pair of opposed side walls upstanding from the base, each side wall defining an opening aligned with the opening in the opposing side wall;

a brace member defining a through opening proximate a first end for attaching at a first end to the U-shaped connector and attaching at an opposing second end to the manufactured building for vertically supporting the manufactured building relative to the ground;

a first fastener extending through the aligned openings in the opposing side walls and the brace member for engaging the first end of the brace member to the U-shaped connector; and a strap for securing at a first end to the U-shaped connector and at a second end to the manufactured building, said strap extending perpendicular from the U-shaped connector to the manufactured building, whereby the shaft and the helical flight driven into the ground below the manufactured building transfers vertical compression loading from the manufactured building through the brace member to the ground and the strap resists vertical tension loading on the manufactured building.

2. The anchor pier as recited in claim 1, further comprising a thermally insulative member disposed adjacent the connector, whereby the connector and the thermally insulative member define in situ a proximate thermally isolated ground column thereunder and the thermally insulative member restricts communication of heat from the proximate thermally isolated ground column for resisting frost heaving.

3. The anchor pier as recited in claim 2, wherein the thermally insulative member is defined by a planar sheet of an insulating material.

4. The anchor pier as recited in claim 2, wherein the thermally insulative member is defined by a spray insulating foam.

5. The anchor pier as recited in claim 1, wherein the brace member comprises a pair of tubular members that telescope together to a selected length for being disposed between the U-shaped connector and the manufactured building.

6. The anchor pier as recited in claim 1, further comprising a secondary support member positioned against the shaft and the U-shaped connector.

7. The anchor pier as recited in claim 6, wherein the secondary support member comprises a cap having a plate that seats against the U-shaped connector and defines an opening for passage of the shaft, the cap having a skirt extending from the perimeter of the cap in a direction substantially parallel to the shaft towards the driving tip.

8. The anchor pier as recited in claim 7, wherein the secondary support member comprises an L-shaped plate having a first leg that seats against the U-shaped connector and a second leg that seats against the shaft during installation of the shaft and helical flight in the ground.

9. The anchor pier as recited in claim 1, further comprising a plate attached to an end of the second tube and having a plurality of holes in spaced-relation for receiving a respective fastener for securing the plate to the manufactured building.

10. The anchor pier as recited in claim 1, wherein the opposing side walls each further define a second opening aligned with the opposing second opening; and further comprising:

a second fastener for extending through the aligned second openings; and the strap for securing at the first end to the second fastener.

11. The anchor pier as recited in claim 10, further comprising a bracket for securing to an elongate beam of the manufactured building, the second end of the strap for securing to the bracket.

12. A method of supporting a manufactured building, comprising the steps of:

(a) driving a shaft into a ground surface beneath with a portion of a manufactured building, the shaft having a U-shaped connector having a base attached at a first end of the shaft and a driving tip at an opposing end with a helical flight positioned proximate the driving tip and a pair of opposed side walls upstanding from the base, each side wall defining an opening aligned with the opening in the opposing side wall;

(b) attaching a first end of a brace member to the U-shaped connector and attaching a second end of the brace member to the manufactured building, the brace member defining a through opening proximate a first end for alignment with the openings in the opposing side walls for receiving a fastener therethrough; and (c) securing a strap at a first end to the U-shaped connector and extending perpendicular therefrom and securing at a second end to the manufactured building, whereby the shaft and the helical flight transfers vertical loading on the manufactured building through the brace member to the ground below the manufactured building while the strap resists vertical tension loading on the manufactured building.

13. The method as recited in claim 12, further comprising a step of disposing a thermally insulative member on the shaft adjacent the U-shaped connector, whereby the thermally insulative member defines in situ a proximate thermally isolated ground column thereunder, which thermally insulative member restricts communication of heat from the proximate thermally isolated ground column for resisting frost heaving.

14. The method as recited in claim 12, wherein the brace member comprises a pair of elongate members and step (b) further comprises telescopingly joining the pair of elongated members to a selected length for extending between the U-shaped connector and the manufactured building, at least one of the pair of elongate members having an end portion that defines the through opening for receiving the fastener to attach the brace member to the U-shaped connector.

15. The method as recited in claim 12, further comprising the step of positioning a secondary support member relative to the U-shaped connector to support the shaft and the helical flight in the ground.

16. The method as recited in claim 15, wherein the step of positioning comprises placing a cap on the shaft to bear against the U-shaped connector, the cap having a skirt extending from the perimeter of the cap in a direction substantially parallel to the shaft towards the driving tip to engage the ground as the shaft and helical flight is driving into the ground.

17. The method as recited in claim 15, wherein the step of positioning comprises seating a first leg of an L-shaped plate against the U-shaped connector and placing a second leg of the L-shaped plate against the shaft during the step of driving the shaft and helical flight into the ground, whereby the first leg contacts a surface of the ground and the second leg is received in the group.

18. The method as recited in claim 12, wherein the shaft is sized so that the helical member is disposed below a frost line of the ground below the manufactured building.

19. The method as recited in claim 12, where step (b) attaching a second end of the brace member to the manufactured building comprises the step of joining a distal end of the brace member to a plate and attaching the plate to the manufactured building.

20. The method as recited in claim 12, further comprising the step of securing a strap at a first end to a second fastener that extends through second aligned openings in the opposing side walls of the U-shaped connector and at a second end to the manufactured building.

* * * * *